US005211121A

United States Patent [19]

Sakakibara

[11] Patent Number: 5,211,121

[45] Date of Patent: May 18, 1993

[54] DEVICE FOR DETECTING REMAINDER OF BOBBIN THREAD IN SEWING MACHINE

[75] Inventor: Yasuo Sakakibara, Nagoya, Japan

[73] Assignee: Brother Kogyo Kabushiki Kaisha, Aichi, Japan

[21] Appl. No.: 805,557

[22] Filed: Dec. 11, 1991

[30] Foreign Application Priority Data

Dec. 14, 1990 [JP] Japan ..... 2-402436

[51] Int. Cl.[5] ..... D05B 59/02

[52] U.S. Cl. ..... 112/278; 242/47

[58] Field of Search ..... 112/278, 273, 279; 250/561, 571, 559; 242/37 R, 47, 159, 174, 176, 20, 23

[56] References Cited

U.S. PATENT DOCUMENTS 4,193,363 3/1980 Beckerman et al. ..... 112/278
4,237,807 12/1980 Meier et al. ..... 112/273 X
4,630,652 12/1986 Dieterich ..... 242/47 X

FOREIGN PATENT DOCUMENTS

WO824447 12/1982 PCT Int'l Appl. ..... 112/273

*Primary Examiner*—Peter Nerbun
*Attorney, Agent, or Firm*—Kane, Dalsimer, Sullivan, Kurucz, Levy, Eisele and Richard

[57] ABSTRACT

A bobbin thread remainder detecting device for detecting an amount of remainder of a bobbin thread wound up around a bobbin for a sewing machine, in which a winding leading end portion of the bobbin in a winding direction reverse to a winding direction of another portion of the bobbin thread, comprises a bobbin rotating direction detecting unit, including light emitting and receiving elements, disposed in a vicinity of a bobbin case for detecting a rotating direction of the bobbin and a bobbin thread remainder detecting unit, including an electronic control circuit element, disposed in association with the rotating direction detecting unit for detecting the amount of the remainder of the bobbin thread in response to rotation of the bobbin in a particular direction as detected by the rotating detecting unit. The bobbin thread remainder detecting unit detects reducing the bobbin thread remainder wound up around the bobbin at a time when the rotating direction of the bobbin changes.

17 Claims, 4 Drawing Sheets

DEVICE FOR DETECTING REMAINDER OF BOBBIN THREAD IN SEWING MACHINE

BACKGROUND OF THE INVENTION

This invention relates to a device for detecting an amount of remainder of a bobbin thread wound up around a bobbin of a sewing machine particularly for detecting a state in which the remainder of the bobbin thread reduces to an amount less than a predetermined amount.

In prior art, there is known a bobbin thread remainder detecting device including a photo-detector disclosed in Japanese Utility Model Laid-open (KOKAI) Publication No. 61-180685, in which when a rotation of a rotating hook is stopped, a light is irradiated to the outer periphery of a bobbin shaft through a hole form on a bobbin case and a reflected light of the irradiation is detected by the photo-detector. The bobbin thread remainder detecting device discriminates whether or not the remainder of the thread is less in amount than the predetermined amount in response to a detection value generated by the photo-detector, and determines whether or not the bobbin should be exchanged when the discrimination is affirmative.

In U.S. Pat. Application Ser. No. 07/692,936, now U.S. Pat. No. 5,103,750 assigned to the assignee of the present application, a bobbin thread remainder detecting device which includes a light detector is disclosed. In the bobbin thread remainder detecting device, the light detector comprises a pair of light receiving elements, for receiving the reflected light from a bobbin shaft, disposed at different positions for the reason that if the reflected light is detected by only one light receiving element, the remainder of the bobbin thread may not be exactly detected because of reduction of a sensitivity due to adhesion of dust or oil to a light detecting portion of the light receiving element. In the arrangement of the paired light receiving elements, the bobbin thread remainder is detected in accordance with the ratio of the received light amounts of both the receiving elements, so that the bobbin thread remainder is detected without an effect of reduction of the sensitivity.

However, it is considered that, according to the bobbin thread remainder detecting device utilizing the light detector of the structure described above, bobbin threads to be wound up around the bobbin generally have various colors sizes, thicknesses, glosses and the like, and the reflected conditions of the light are significantly and minutely different in accordance with these features of the bobbin threads to be used. This may result in that the amount of the remainder of the bobbin thread calculated by the above mentioned method does not correspond to the really exact amount thereof, and in fact, in the experiments, there obtained the different results in the discrimination of the calculated results, made in accordance with the above mentioned method, as to whether or not the calculated bobbin thread remainder amount is less than the predetermined amount in spite of the fact that the same amounts of the bobbin threads in fact remained in different cases.

Furthermore, in the bobbin thread remainder detecting device described above, since the remainder is detected by detecting the mass of the bobbin thread wound up around the bobbin, the lengths of the actual bobbin thread remainders are different in dependency on the size or thickness of the bobbin thread when it is the discriminated that the bobbin thread remainder is less than the predetermined amount.

SUMMARY OF THE INVENTION

An object of this invention is to substantially eliminate defects or drawbacks encountered in the related art and to provide a device for detecting an amount of remainder of a bobbin thread wound up around a bobbin of a sewing machine capable of exactly detecting and discriminating a fact as to whether or not the remainder of the bobbin threads reduces to an amount less than a predetermined amount regardless of condition of the bobbin threads such as sizes, thicknesses, colors, materials and glosses of the bobbin threads.

Another object of this invention is to provide a sewing machine equipped with the device for detecting an amount of remainder of a bobbin thread wound up around a bobbin of the character described above.

These and other objects of this invention can be achieved by providing a device for detecting an amount of remainder of a bobbin thread wound up around a bobbin rotatably mounted on to a shaft member of a bobbin case of a sewing machine in a state that a winding leading end portion of the bobbin thread is wound up around the bobbin in a winding direction reverse to a winding direction of another portion of the bobbin thread, the bobbin thread remainder detecting device comprising a bobbin rotating direction detecting means disposed in a vicinity of the bobbin case for detecting a rotating direction of the bobbin and a bobbin thread remainder detecting means disposed in association with the rotating direction detecting means for detecting the amount of the remainder of the bobbin thread in response to the rotating direction of the bobbin detected by the rotating direction detecting means. The bobbin thread remainder detecting means detects reducing of the remainder of the bobbin thread wound up around the bobbin at a time when the rotating direction of the bobbin changes.

In another aspect, there is provided a sewing machine including a bed provided with a throat plate, a needle vertically movable through the throat plate, a rotating hook assembly disposed inside the bed and including a bobbin case holder for holding a bobbin case, and a bobbin winding device installed on a sewing machine table, the sewing machine further comprising a bobbin around which a bobbin thread is wound up such that a winding leading end portion of the bobbin thread is wound up therearound in a winding direction reverse to a winding direction of another portion of the bobbin thread, a bobbin rotating direction detecting means, and a bobbin thread remainder detecting means disposed in association with the rotating direction detecting means for detecting the amount of the remainder of the bobbin thread based on the rotating direction of the bobbin detected by the rotating direction detecting means and for detecting reducing of the bobbin thread remainder wound up around the bobbin at a time when the rotating direction of the bobbin changes.

In a preferred embodiment, a bobbin rotating direction display means rotated in the same direction as the rotating direction of the bobbin is further provided. The rotating direction detecting means detects the rotating direction of the bobbin by way of the rotating direction display means. The bobbin rotating direction display means comprises a display plate mounted on to the shaft of the bobbin case. The rotating direction detecting means comprises a pair of light emitting elements for emitting lights towards the bobbin rotating direction display means and a pair of light receiving elements for receiving light reflected by the light emitting elements and the bobbin thread remainder detecting means comprises an electronic circuit control unit for comparing signals representing quantities of lights received by the light receiving elements and discriminating the rotating direction of the bobbin.

According to the bobbin thread remainder detecting device of the characters described above, in which the bobbin thread is wound up around the bobbin in different winding directions at the winding leading end portion and other portion of the bobbin thread, the rotating direction of the bobbin changes during the consumption of the bobbin thread. The change of the rotating direction is detected by the rotating direction detecting means, when the rotating direction changes, the reducing of the remainder of the bobbin thread is detected and discriminated by the bobbin thread remainder detecting means. The rotating direction change detection is performed in association with the rotating direction display means mounted on to the bobbin case shaft to be rotatable in the same direction of the rotation of the bobbin.

Accordingly, the rotating direction of the bobbin changes at a time when the remainder of the bobbin thread is reduced to the predetermined amount of the bobbin thread wound up around the bobbin, thus precisely detecting the remainder of the bobbin thread regardless of the sizes, colors, thicknesses, materials and the like of the bobbin threads.

BRIEF DESCRIPTION OF THE DRAWINGS

For a better understanding of this invention and to show how the same is carried out, reference will be now made, by way of a preferred embodiment, to the accompanying drawings, in which.

DESCRIPTION OF THE PREFERRED EMBODIMENT

A bobbin winding device 1 for winding a bobbin thread in directions different at a winding start portion, i.e., winding leading end portion, of the bobbin thread and another portion thereof will be described hereunder with reference to FIGS. 1 to 3.

Figure 1:
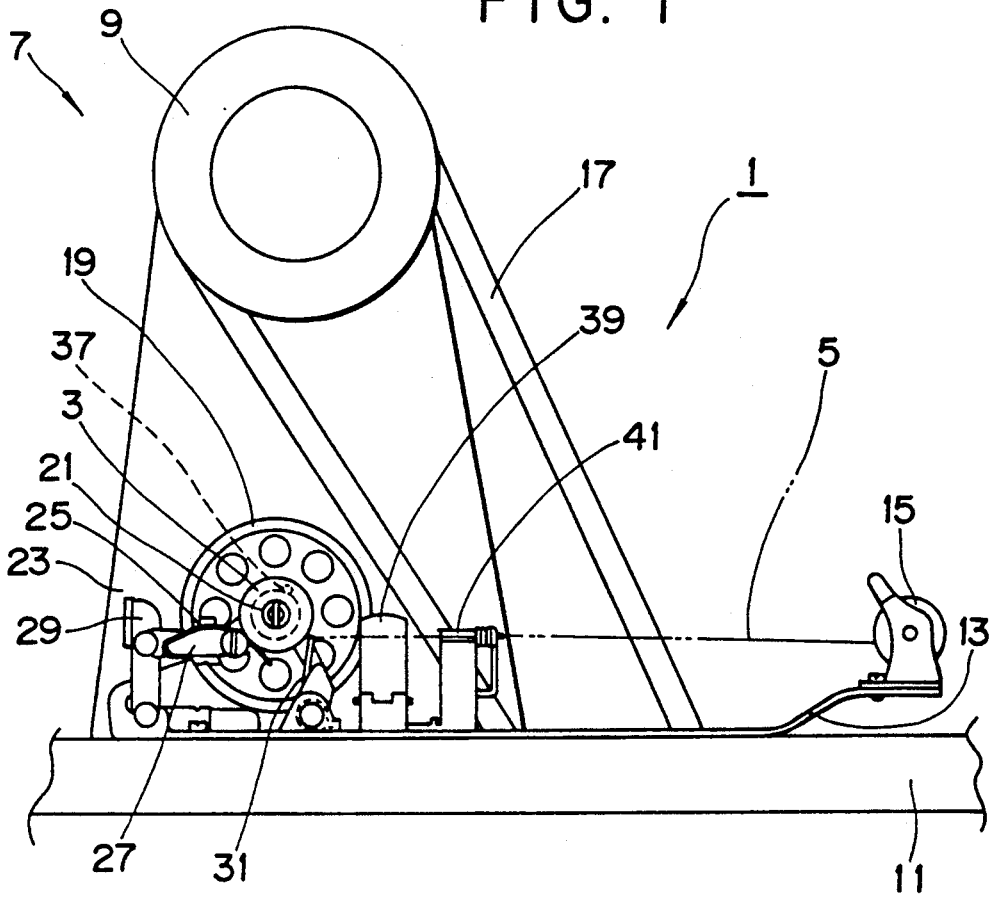
FIG. 1 is a front view of a bobbin winding device in an assembled state.

First, referring to FIG. 1, the bobbin winding device 1 is mounted on a sewing machine table 11 through a bobbin winding pedstal 13 on the side of a balance wheel 9 of a sewing machine 7 and is adapted to wind up, around a bobbin 3, a bobbin thread 5 with a tension being adjusted to a predetermined amount by a bobbin winder tension disk 15. The bobbin winding device 1 is driven by a driving force generated by an electric motor, not shown, for driving the sewing machine 7. Namely, the driving force of the electric motor is transmitted to the sewing machine 7 through a V-shaped belt 17 and the balance wheel 9, and is transmitted to the bobbin thread winding device 1 through the V-shaped belt 17 and a bobbin winding pulley 19.

The bobbin winding pulley 19 is formed to be integral with a bobbin winding shaft 21 to which the bobbin 3 is detachably mounted and the bobbin winding pulley 19 is also supported by a link mechanism 23 to be movable between a rotation position at which the bobbin thread contacts or abuts against the V-shaped belt 17 and a retreat position at which the thread does not contact the V-shaped belt 17. The link mechanism 23 is per se known type in which, in an arrangement of a link plate 27 to which a bobbin press 25 is secured to be linearly arrangement in alignment with another link plate 29, the bobbin winding pulley 19 is moved to the rotation position and, on the other hand, when the bobbin press 25 is displaced backward by a predetermined amount by the bobbin thread 5 wound up around the bobbin 3, the bobbin winding pulley 19 is displaced to the retreat position by the urging force of a cylindrical coil spring 31.

Figure 2:
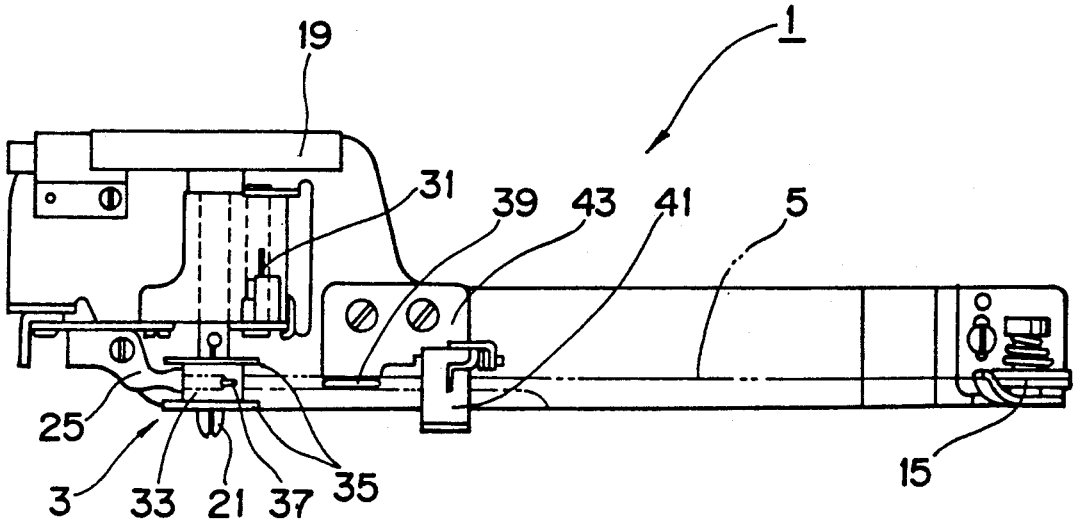
FIG. 2 is a plan view of the bobbin winding device as viewed from the upper side of FIG. 1.

Referring to FIG. 2, the bobbin 3 is provided with a hollow shaft portion 33 around which the bobbin thread 5 is wound up and a pair of flanged portions 35 formed at both ends of the hollow shaft portion 33. A projection 37 is provided on the outer periphery of the hollow shaft portion 33 for turning back the winding leading end portion of the bobbin thread 5. Onto the bobbin winding pedestal 13 are mounted a separation plate 39 and a holding plate 41 which are supported by a support member 43. The separation plate 39 acts to separate the leading end portion of the turned-back bobbin thread 5 from the portion of the bobbin thread 5 fed from the bobbin winder tension disk 15 so as not to get tangled together. The holding plate 41 acts to hold in air the leading end portion of the bobbin thread 5 together with the bobbin thread portion fed from the bobbin winder tension disk 15.

The separation plate 39 and the holding plate 41 will be described in detail hereunder with reference to FIG. 3.

Figure 3:
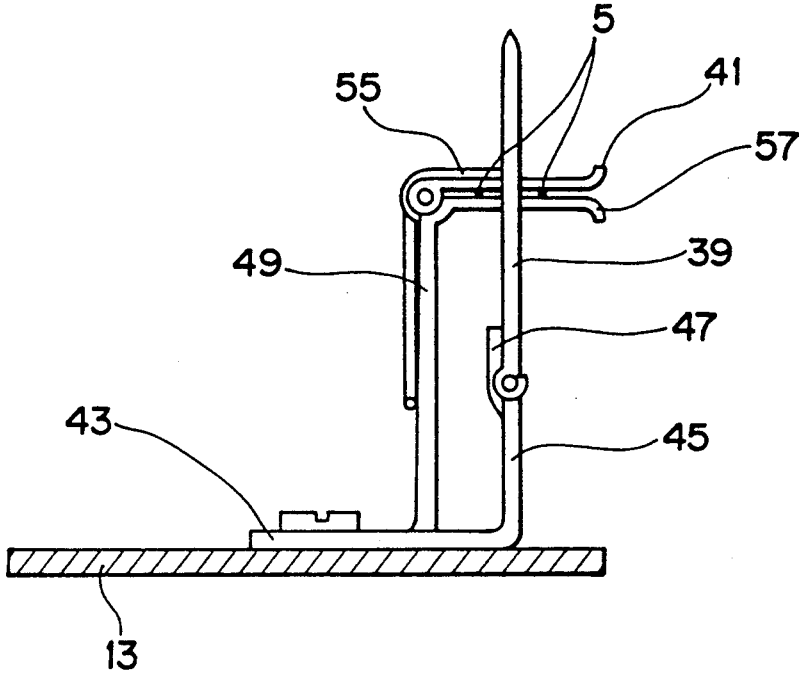
FIG. 3 is a partial view of the bobbin winding device of FIG. 1 showing the structure of a separation plate and a support plate for a bobbin thread.

Referring to FIG. 3, the separation plate 39 is supported by and connected to, in a manner rotatable in the clockwise direction as viewed, a separation plate supporting portion 45 of the support member 43 secured to the bobbin winding pedestal 13 so that the supporting portion extends upwardly. The separation plate 39 is engaged at its one end with an engaging piece 47 attached to the extended end of the supporting portion 45 so as not to rotate in the counterclockwise direction as viewed in FIG. 3.

The holding plate 41 is supported by and connected to, in a rotatable manner, a holding plate supporting portion 49 attached to the support member 43 so as to extend upwardly, i.e., in a direction normal to the bobbin winding pedestal 13. The holding plate 41 is pressed, by means of a cylindrical coil spring 55, against the surface of a holding plate receiving plate 57 provided at the extended end of the supporting portion 49 so as to extend in a horizontal direction, and the bobbin thread 5 is held between the holding plate 41 and the surface of the holding plate receiving plate 57.

According to the bobbin winding device 1 of the structure described above, the bobbin thread 5 is first mounted on to the bobbin 3 in a state such that a portion of the bobbin thread 5 apart by a predetermined amount from the leading end thereof is turned back by the projection 37. The bobbin 3 is then mounted on to the bobbin winding shaft 21 with the bobbin thread 5 being in the described state, and the portion of the bobbin thread 5 fed from the bobbin winder tension disk, 15 and the leading end thereof are put between the holding plate 41 and the holding plate receiving plate 57 so that both the bobbin thread portions are positioned on both sides of the separation plate 39 as shown in FIG. 3. In this manner, the bobbin 3 and the bobbin thread 5 are incorporated in the bobbin winding device 1. In the next step, the motor is driven and the link mechanism 23 is operated to move the bobbin winder pulley 19 to its rotating position, whereby the bobbin thread 5 is wound up around the bobbin 3.

In accordance with the described manner, the driving force is transmitted to the bobbin 3 through the V-shaped belt 17 and the bobbin winder pulley 19 to thereby simultaneously wind up the bobbin thread portions separated on both sides of the separation plate 39. In this winding operation, since the leading end portion of the bobbin thread 5 is turned back by the projection 37, this leading end portion of the bobbin thread 5 can be wound up around the bobbin 3 in a winding direction reverse to that of the portion of the bobbin thread 5 fed from the bobbin winder tension disk 15. Further, at the bobbin thread winding up starting time, since the leading end portion thereof is put between the holding plate 41 and the receiving plate 57, the bobbin thread 5 is prevented from being released from the projection 37, thus the winding miss of the bobbin thread 5 being prevented. Furthermore, the separation plate 39 is constructed to be fallen down due to contact with the bobbin thread 5 fed from the bobbin winder tension disk 15 after the winding up of the leading end portion of the bobbin thread 5 around the bobbin. Therefore, the portion of the bobbin thread 5 fed from the bobbin winder tension disk 15 can be substantially entirely and uniformly wound up around the hollow shaft 33 of the bobbin 3.

The bobbin thread remainder detecting device constituting an important structure of this invention will be described hereunder with reference to FIGS. 4 to 7.

Figure 4:
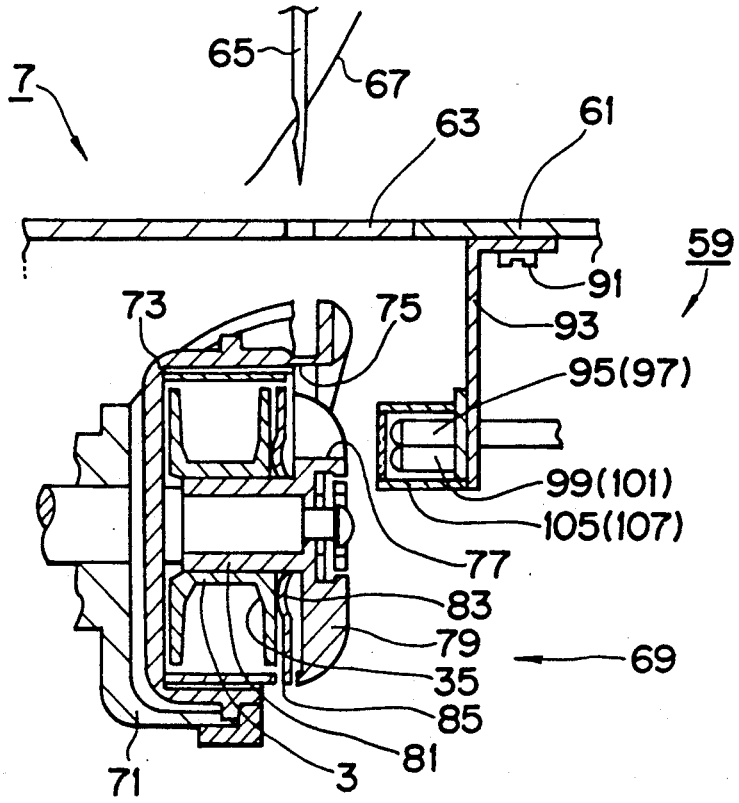
FIG. 4 is a sectional side view of a device for detecting a bobbin thread remainder of a sewing machine in a state to be assembled.
Figure 5:
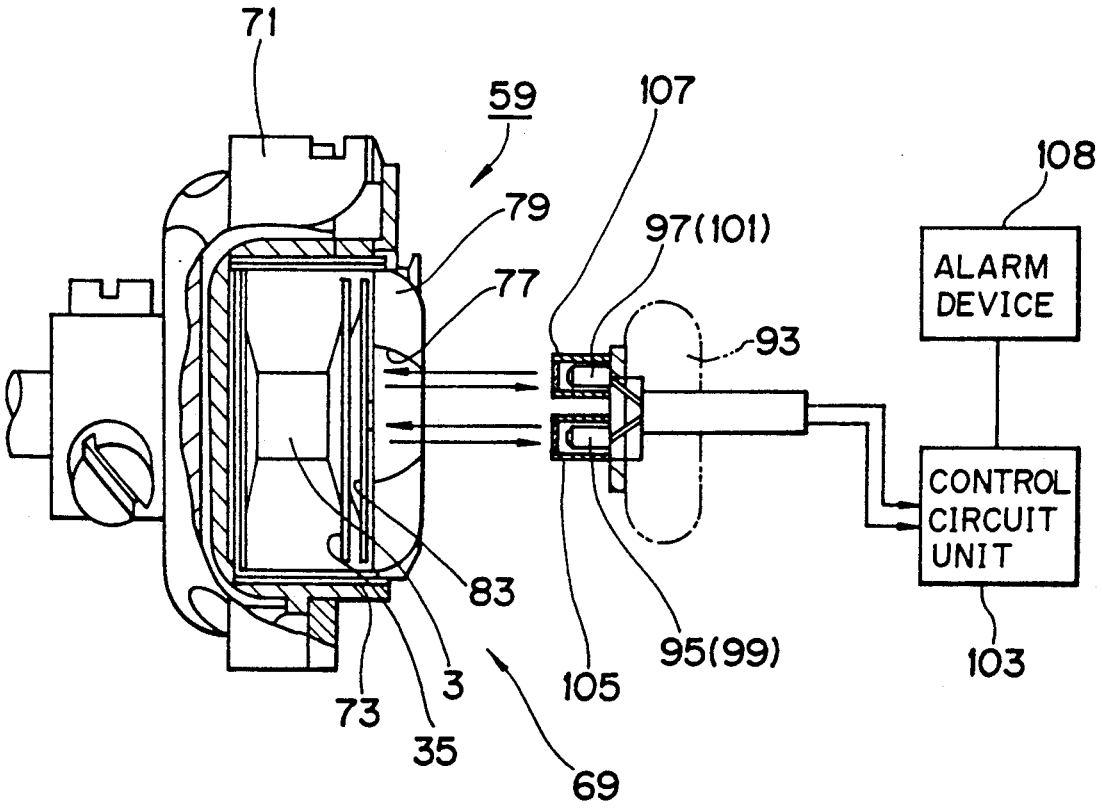
FIG. 5 is a sectional plan view of the bobbin thread remainder detecting device of FIG. 4.

First, referring to FIGS. 4 and 5, a rotating hook assembly 69 is disposed in a bed 61 of the sewing machine 7. The rotating hook assembly 69 forms a lock stitch to a work fabric, not shown, by catching a needle thread 67 in operative association with a needle 65 being movable vertically through a throat plate 63. The rotating hook assembly 69 includes a rotating hook 71 capable of being rotated in synchronism with the vertical motion of the needle 65 and a bobbin case holder 73 stationarily disposed inside the rotating hook 71. The bobbin case holder 73 is provided with an accommodation portion 75 to which a bobbin case 79 provided with a window or window-like portion 77 is detachably positioned. A hollow supporting shaft 81 is projected from the inner wall of the bobbin case 79 and the bobbin 3 is mounted on to the hollow supporting shaft 81 to be detachable and rotatable. A rotating direction display plate 83 is also rotatably mounted on to the supporting shaft 81.

The rotating direction display plate 83 is formed of a dish-like thin steel plate having small and large diameter portions and is arranged so that an end face of the small diameter portion of the dish-like display plate 83 abuts against a flanged portion 35 of the bobbin 3. The rotating direction display plate 83 is provided with an engaging piece 87 at the lower end, as viewed in FIG. 6 or 7, thereof, which is adapted to limit the rotation of the display plate 83 in engagement with an engaging hole formed on the side surface of the bobbin case 79. The display plate 83 is also provided with a colored portion or portions 89 on the surface facing the bobbin case 79 so that the colored portion 89 has an area substantially half the area of the window 77 of the bobbin case 79.

The rotating direction display plate 83 of the structure described above is rotated or swung in accordance with the rotation of the bobbin 3 in a range defined by the width of the engaging hole 85 in its rotating direction, and according to such a swinging motion, the colored portion 89 is observed in different states through the window 77 in the following manner.

Figure 6:
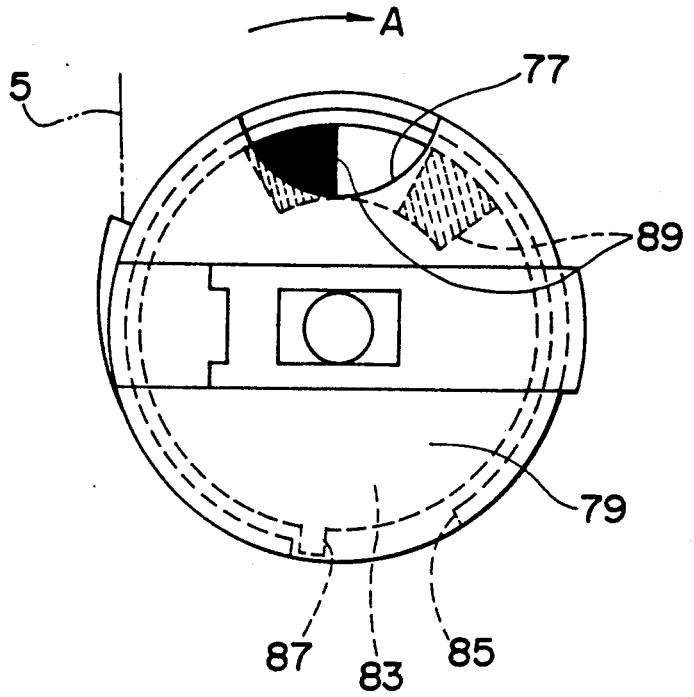
FIGS. 6 and 7 are plan views of a rotating direction display plate incorporated in the device shown in FIG. 4 for the explanatory of the operation thereof, respectively.
Figure 7:
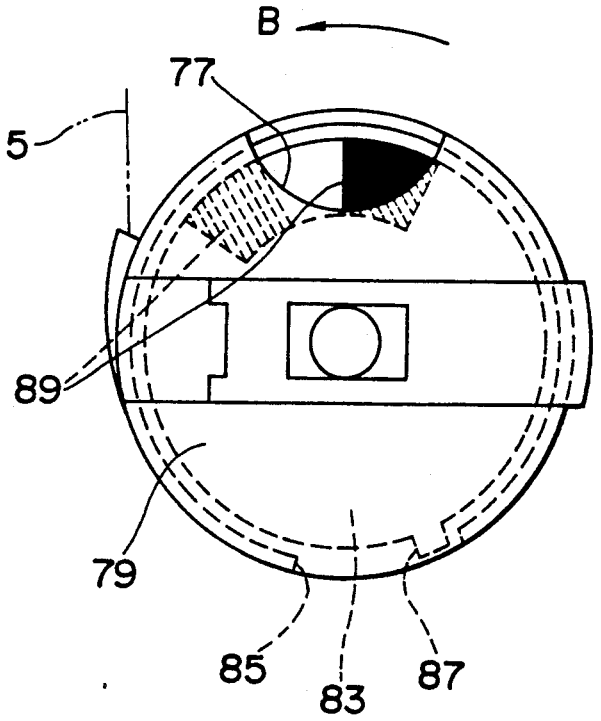

Namely, as shown in FIG. 6, when the bobbin 3 is rotated in an arrowed direction A, the rotating direction display plate 83 is also rotated in the direction A, so that the colored portion 89 appears on the lefthand side of the window 77 as viewed in this figure, and on the contrary, as shown in FIG. 7, when the bobbin 3 is rotated in an arrowed direction B, the rotating direction display plate 83 is also rotated in this direction B, so that the colored portion 89 appears on the righthand side of the window.

Now, the bobbin thread remainder detecting device 59 detects the rotating direction of the bobbin 3 under the observation of the state of the colored portion 89 appearing on both sides of the window 77 and the reducing amount of the remainder of the bobbin thread 5 is thereby detected.

Namely, as shown in FIGS. 4 and 5, the bobbin thread remainder detecting device 59 according to the present invention comprises a pair of bilateral light emitting elements 95 and 97, a pair of bilateral light receiving elements 99 and 101 as rotating direction detecting means and an electronic control circuit unit 103 as means for detecting and discriminating reducing amount of the bobbin thread remainder. The light emitting elements 95 and 97 are secured to a supporting member 93 which is fixed to the rear surface of the bed 61 of the sewing machine 7 by means of a vise, for example, and positioned so as to face respectively both the end portions of the window 77 formed at the periphery of the bobbin case 79. The light receiving elements 99 and 101 are also positioned so as to face both the end portions of the window 77 and adapted to receive lights respectively irradiated from the light emitting elements 95 and 97 reflected by the rotating direction display plate 83. The electronic control circuit unit 103 operates so as to receive signals from the light receiving elements 99 and 101 and detect the amount of the remainder of the bobbin thread 5 in accordance with the received signals.

The light emitting element 95 and the light receiving element 99 are covered with a case 105 provided with a light transmissive front end portion, and the light emitting element 97 and the light receiving element 101 are also covered with a case 107 provided with a light transmissive front end portion. Lens units are integrally provided for the front end portions of these light emitting and receiving elements, respectively.

According to the bobbin thread remainder detecting device 59 of the structure described above, the remainder of the bobbin thread 5 is detected in the following manner.

First, when the light emitting elements 95 and 97 are operated, spot lights are transmitted therefrom towards the portion of the rotating direction display plate 83 exposed through the window 77 formed in the bobbin case. The light receiving elements 99 and 101 respectively receive the light reflected by the exposed portion, corresponding to both the end portions of the window 77, of the rotating direction display plate 83. The light receiving elements 99 and 101 then transmit detecting signals in proportion to the inputted light amounts. Accordingly, since the output of the signal from either one of the light receiving elements 99 or 101 corresponding to the colored portion 89 of the display plate 83 is reduced, the rotating direction of the bobbin 3 can be detected by the control circuit unit 103 by comparing and discriminating the outputs of the signals from the light receiving elements 99 and 101.

In this embodiment, since the bobbin thread 5 is wound up around the bobbin 3 by the bobbin winding device 1 in a manner such that the winding direction of the leading end portion of the bobbin thread 5 is reverse to that of the other portion thereof fed from the bobbin winder tension disk 15, when the length of the bobbin tread 5 is reduced to the amount preliminarily set, the rotating direction of the bobbin 3 changes from the direction A to the direction B, for example. In this instance, the magnitudes of the outputs signals from the light receiving elements 99 and 101 are reversed. This fact is detected and discriminated by the electronic control circuit unit 103 and an alarm signal is generated toward an alarm device 108 such as buzzer whereby the reduction of the remainder of the bobbin thread 5 can be informed.

According to the bobbin thread remainder detecting device of this invention, the rotating direction of the bobbin 3 changes at a time when the amount of the remainder of the bobbin tread 5 reduces to the predetermined length by mounting the bobbin 3 in which the winding leading end portion of the bobbin thread 5 is wound up around the bobbin in a direction reverse to the winding direction of another portion thereof. The fact of the rotating direction changing is detected by the electronic control circuit 103 and an alarm is generated by the alarm device 108 to inform of the fact that the remainder of the bobbin threads 5 reduces to the predetermined amount. Namely, the remainder of the bobbin thread 5 is detected in dependency on the rotating direction of the bobbin 3, so that the remainder can be exactly detected regardless of the thickness, size, color, material and the like of the bobbin thread 5.

In the described preferred embodiment, the bobbin thread 5 is wound up around the bobbin 3 in different directions at the winding leading end portion and other portion of the bobbin thread 5 by utilizing the bobbin winding device 1 including the bobbin thread separation plate 39 and the holding plate 41, but this invention is not limited to such a structure, and a conventional bobbin winding device including no separation plate 39 and holding plate 41 may be utilized for winding the bobbin thread in the different directions in a manner that the bobbin thread 5 is wound up around the bobbin 3 while the front end of the bobbin thread turned by the projection 37 is softly pinched by an operator. Furthermore, a conventional bobbin provided with no projection such as the projection 37 may be also utilized, and in such a case, the winding leading end portion of the bobbin thread 5 is first wound up around the bobbin by an operator in a direction reverse to the winding direction of the bobbin winding device and the succeeding portion of the bobbin thread 5 is then wound up thereafter around by several winding numbers by the operator in the same direction as the winding direction of the bobbin winding device. Finally, succeeding portion of the bobbin thread 5 is wound up by the bobbin winding device. In this manner, the bobbin thread 5 can be wound up around the bobbin in different directions at the winding leading end portion and other portions of the bobbin.

Moreover, in the present bobbin thread remainder detecting device 59, the swinging or rotating position of the rotating direction display plate 83, that is, the rotating direction of the bobbin 3 is detected by optically detecting the position of the colored portion 89 of the display plate 83, but this invention is not limited to this technique and various other methods may be utilized. For example, the rotating direction of the bobbin may be detected, by a switching means, for example, by directly detecting the rotating direction of the display plate which is rotated in the same direction of the bobbin. In another example, the bobbin rotating direction may be detected by providing a disk on which a bar-cord is described and which is integrally rotated with the bobbin and successively reading the bar-cord of the rotating disk by utilizing a light detector secured to a portion facing the bar-code.

In the described embodiment, there is disclosed one preferred example in which respective two pairs of the light emitting elements 95, 97 and light receiving elements 99, 101 are utilized as an optical means for detecting the rotating direction of the bobbin, but in a modified example, one pair of light emitting element and light receiving element, for example, 95 and 97, may be utilized for detecting the change in the rotating direction of the bobbin 3. In such modified arrangement, the electronic control circuit unit 103 will actuate the alarm device 108 at a time when the light amount detected by the single light receiving element 95 changes in accordance with the change of the position of the colored portion 89 of the display panel 83.

What is claimed is:

1. A device for detecting an amount of remaining bobbin thread wound up around a bobbin which is rotatably mounted on to a shaft member of a bobbin case of a sewing machine provided with a bed comprising:

means mounted to the bed of the sewing machine in a vicinity of the bobbin case for detecting a rotating direction of the bobbin, wherein a winding leading end portion of the bobbin thread is wound up around the bobbin in a winding direction reverse to a winding direction of another portion of the bobbin thread;

means operatively connected to the rotating direction detecting means for detecting the amount of the remainder of the bobbin thread based on the rotating direction of the bobbin detected by said rotating direction detecting means; and means disposed in the bobbin case for displaying the rotating direction of the bobbin.

2. A bobbin thread remainder detecting device according to claim 1, wherein said bobbin thread remainder detecting means detects reducing of the bobbin thread remainder wound up around the bobbin at a time when the rotating direction of the bobbin changes.

3. A bobbin thread remainder detecting device according to claim 1, wherein said rotating direction detecting means detects the rotating direction of the bobbin based on the rotating direction displayed by said rotating direction display means, said bobbin rotating direction display means comprising a display plate rotatably mounted to the shaft of the bobbin in the same direction as the rotating direction of the bobbin.

4. A bobbin thread remainder detecting device according to claim 1, wherein said display plate is provided with a marked portion which appears in response to the rotating direction of the bobbin, said rotating direction detecting means detects an appearance of the marked portion of the display plate and said bobbin thread remainder detecting means detects the amount of the remainder of the bobbin thread in accordance with a detection of the appearance of the marked portion by said rotating direction detecting means.

5. A bobbin thread remainder detecting device according to claim 4, wherein said display plate is provided with an engaging piece formed at a peripheral portion thereof and said bobbin case is provided with an engaging hole engageable with said engaging piece for limiting a rotating amount of said display plate in an engagement between said engaging piece and said engaging hole, said bobbin case being further provided with a cut-away portion as a window at a portion corresponding to the marked portion of said display plate.

6. A bobbin thread remainder detecting device according to claim 5, wherein said marked portion is composed of two colored parts positioned at portions corresponding to lateral ends of said window and said engaging piece is engaged with said engaging hole at a time when one of said colored portion of the display plate is rotated to a position occupying substantially a half area of the window.

7. A bobbin thread remainder detecting device according to claim 6, wherein said rotating direction detecting means comprises a pair of light emitting elements for emitting lights towards said display plate, a pair of light receiving elements for receiving lights reflected by said display plate and for generating detected signals representing lights received by said light receiving elements, and an electronic control circuit unit for processing the detected signals generated by said light receiving elements in such a manner that outputs of the detected signals are compared with each other and that change of the rotating direction is discriminated when the magnitudes of their outputs of the detected signals are reversed thereby to discriminate the amount of the remainder of the bobbin thread.

8. A bobbin thread remainder detecting device according to claim 7, wherein said bobbin thread remainder detecting means further comprises an alarm means connected to said electronic control circuit unit and adapted to generate an alarm at a time when the electronic control unit discriminates the change of the rotating direction.

9. A bobbin thread remainder detecting device according to claim 3, wherein said rotating direction detecting means comprises a light emitting element for emitting light towards said bobbin rotating direction display means and a light receiving element for receiving light reflected by said bobbin rotating direction display means and for generating a detecting signal representing light received by said light receiving element, and wherein said bobbin thread remainder detecting means comprises an electronic circuit control unit for processing the detecting signal generated by said light receiving element and discriminating changing of the rotating direction of the bobbin based on changing of the detecting signal for determining the amount of the remainder of the bobbin thread.

10. A sewing machine including a bed, a reciprocable needle and a rotating hook assembly disposed in the bed, said sewing machine comprising:

a bobbin case disposed below the bed in an installed state and having a shaft member;

a bobbin which is mounted on the shaft member of the bobbin case and around which a bobbin thread is wound up such that a winding leading end portion of the bobbin thread having a predetermined length is wound up therearound in a winding direction reverse to a winding direction of another portion of the bobbin thread;

detecting means mounted to the bed in a vicinity of the bobbin case for detecting a rotating direction of the bobbin;

determining means disposed in association with the detecting means for determining whether the length of the remainder of the bobbin thread reaches the predetermined length based on the rotating direction of the bobbin detected by said detecting means, said determining means determining that the length of the remainder of the bobbin thread reaches the predetermined length when the rotating direction of the bobbin changes and, a display plate supported in said rotating hook assembly for rotation in the same direction as the rotating direction of the bobbin, said display plate being provided with a marked portion which appears in response to rotation of the bobbin in a particular direction, wherein said detecting means detects the rotating direction of the bobbin by detecting an appearance of the marked portion of the display plate.

11. A sewing machine according to claim 10, wherein said bobbin includes flanged portions formed to both ends of the shaft portion and a projection formed on the shaft portion, and wherein the winding leading end portion of the bobbin thread is turned back by engaging with said projection.

12. A sewing machine according to claim 11, further comprising a bobbin winding device including a bobbin winding pedestal, a bobbin winding pulley rotatably supported by the bobbin winding pedestal and detachably mounting said bobbin, a bobbin winder tension disk attached to the bobbin winding pedestal, a separation plate for separating the winding leading end portion of the bobbin thread turned back by the projection from another portion thereof fed from said bobbin winder tension disk so as not to get tangled together, a holding plate for holding in air the winding leading end portion of the bobbin thread together with another portion thereof fed from the bobbin winder tension disk, and a support member secured to the bobbin winding pedestal and adapted for pivotably supporting said separation plate.

13. A sewing machine according to claim 10, wherein said detecting means comprises a light emitting element for emitting light towards said display plate and a light receiving element for receiving light reflected by said display plate and for generating a detecting signal representing intensity of light received by said light receiving element, and wherein said determining means comprises an electronic circuit control unit for determining changing of the rotating direction of the bobbin based on changing of the detecting signal.

14. A sewing machine, according to claim 13, wherein said display plate is provided with an engaging piece and said rotating hook assembly is provided with an engaging hole engageable with said engaging piece for limiting a rotating amount of said display plate in an engagement between said engaging piece and said engaging hole, said rotating hook assembly is further provided with a cut-away portion as a window at a portion corresponding to the marked portion of said display plate.

15. A sewing machine according to claim 14, wherein said marked portion is composed of two colored parts positioned at portions corresponding to lateral ends of said window and said engaging piece is engaged with said engaging hole at a time when one of said colored portion of the display plate is rotated to a position occupying substantially a half area of the window.

16. A sewing machine according to 15, wherein said detecting means comprises a pair of light emitting elements for emitting lights towards said display plate, a pair of light receiving elements for receiving lights reflected by said display plate and for generating detecting signals representing intensity of lights received by said light receiving elements, and an electronic control circuit unit for processing the detecting signals generated by said light receiving elements in such a manner that outputs of the detected signals are compared with each other and that change of the rotating direction is discriminated when the magnitudes of their outputs of the detected signals are reversed thereby to discriminate that the amount of the remainder of the bobbin thread becomes less than the predetermined length.

17. A sewing machine according 16, wherein said determining means further comprises an alarm means connected to said electronic control circuit unit and adapted to generate an alarm at a time when the length of the remainder of the bobbin thread becomes less than the predetermined amount.

* * * * *